US005148819A

United States Patent [19]

Fagg

[11] Patent Number: 5,148,819

[45] Date of Patent: Sep. 22, 1992

[54] PROCESS FOR EXTRACTING TOBACCO

[75] Inventor: Barry S. Fagg, Winston-Salem, N.C.

[73] Assignee: R. J. Reynolds Tobacco Company, Winston-Salem, N.C.

[21] Appl. No.: 746,252

[22] Filed: Aug. 15, 1991

[51] Int. Cl.[5] ..... A24B 15/24; A24B 15/26

[52] U.S. Cl. ..... 131/297; 131/298

[58] Field of Search ..... 131/297, 298

[56] References Cited

U.S. PATENT DOCUMENTS

| | | |
|---|---|---|
| 283,622 | 8/1883 | Liebreich et al. . |
| 1,671,259 | 5/1928 | Schloesing . |
| 1,949,012 | 2/1934 | Frank . |
| 2,805,667 | 9/1957 | Von Bethmann . |
| 2,995,476 | 8/1961 | Hind et al. . |
| 3,046,997 | 7/1962 | Hind . |
| 3,139,435 | 6/1964 | Staley et al. . |
| 3,147,199 | 9/1964 | Neel . |
| 3,147,200 | 9/1964 | Neel . |
| 3,151,118 | 9/1964 | Moser . |
| 3,390,685 | 7/1968 | Von Bethmann et al. . |
| 3,396,735 | 8/1968 | Von Bethmann et al. . |
| 4,200,113 | 4/1980 | Schmidt . |
| 4,260,836 | 4/1981 | Levy . |
| 4,967,771 | 11/1990 | Fagg et al. . |
| 5,025,812 | 6/1991 | Fagg et al. . |

FOREIGN PATENT DOCUMENTS

72/3935 6/1972 South Africa .

OTHER PUBLICATIONS

Claffey et al., *Ind. Eng. Chem.*, vol. 42, pp. 166–171 (1950).

Karr, *A. I. Ch. E. Journal*, vol. 5, pp. 446–452 (1959).

*Primary Examiner*—V. Millin

[57] ABSTRACT

Tobacco extracts are provided by first extracting tobacco material with water and then subjecting the resulting aqueous tobacco extract to a liquid/liquid extraction process using a long chain alcohol. Preferably, the pH of the aqueous extract is adjusted to about 9 or above prior to the liquid/liquid extraction step. The two immiscible solvents then are separated from one another such that there is provided an aqueous tobacco extract having certain extracted tobacco components removed therefrom and long chain alcohol solvent having extracted tobacco components carried thereby. The processed aqueous extract can be spray dried to provide a concentrated tobacco extract which then can be employed as flavorful forms of tobacco for cigarette and other smoking articles.

19 Claims, 2 Drawing Sheets

PROCESS FOR EXTRACTING TOBACCO

BACKGROUND OF THE INVENTION

The present invention relates to tobacco extracts, and in particular to processes for providing tobacco extracts having certain amounts of selected components removed therefrom.

Popular smoking articles such as cigarettes have a substantially cylindrical rod shaped structure and include a charge of smokable material such as shreds or strands of tobacco (i.e., cut filler) surrounded by a wrapper such as paper thereby forming a tobacco rod. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

Tobacco undergoes various processing steps prior to the time that it is used for cigarette manufacture. Oftentimes, tobacco is chemically or physically treated to increase the flavor and improve the smoking characteristics of the tobacco. In certain circumstances, it may be desirable to selectively remove components such as nicotine from tobacco as well as from processed forms of tobacco such as tobacco extracts. Various processes directed toward removing nicotine from tobacco have been proposed. Many of such types of processes are discussed in European Patent Application No. 280,817 and U.S. Pat. No. 4,744,375 to Denier, et al. Another process for removing nicotine from tobacco is described in European Patent Application No. 323,699. See, also, U.S. Pat. No. 4,967,771 to Fagg, et al., and U.S. Pat. No. 5,025,812 to Fagg, et al., and U.S. patent application Ser. No. 484,587, filed Feb. 23, 1990, now U.S. Pat. No. 5,065,775.

It would be desirable to provide a process for efficiently and effectively processing tobacco extracts so as to remove selected components therefrom.

SUMMARY OF THE INVENTION

The present invention relates to a process for providing a refined tobacco extract, and in particular to a tobacco extract having significant amounts of certain components removed therefrom. The present invention also relates to a process for providing tobacco components which have been removed from a tobacco extract. The process involves extracting various components from tobacco material using a first liquid solvent. The resulting extracted components carried by or provided within the first solvent (i.e., tobacco extract) are contacted with a second liquid solvent which is immiscible with the first solvent. Some of the tobacco components within the first solvent are transferred to within the second solvent, and the first and second solvents are separated from one another. The extracted tobacco components within the first and second solvents then can be isolated from the respective solvents.

More particularly, the process of the present invention involves extracting components from tobacco materials using a first solvent having an aqueous character. As such, an aqueous tobacco extract and a water insoluble tobacco portion are provided. A significant portion of the aqueous extract is separated from the insoluble portion. The aqueous extract then is contacted with a second solvent which is immiscible with the first solvent, and which exhibits a density different from the first solvent. For example, when the first solvent is water, a second solvent is an alcohol which is immiscible in water, and has a density different from that of water. Depending upon the manner in which the aqueous extract is treated prior to the time that contact with the second solvent is effected (e.g., the manner in which the pH of the aqueous extract is altered), selected components of the aqueous extract are removed by the second solvent. For example, an aqueous tobacco extract which is adjusted to a pH of about 9 or above can have substantially all of the nicotine thereof removed using a second solvent which is a good solvent for nicotine. After contact of the aqueous extract and the second solvent has occurred for the desired period of time, the aqueous extract and the second solvent are separated from one another. As such, an aqueous extract having a very low amount of nicotine is separated from the second solvent which contains the nicotine extracted from the aqueous tobacco extract. The tobacco components contained within either or both of the first and second solvents then can be isolated from the first and second solvents, respectively.

The process of the present invention provides the skilled artisan with an efficient and effective method for removing and isolating selected tobacco components of an aqueous extract of tobacco. For example, an aqueous extract of tobacco having a pH of about 7 or above can be subjected to a liquid/liquid extraction process using an alcohol (e.g., n-decyl, cetyl alcohol or oleyl alcohol) as a second solvent so as to remove a significant portion of nicotine and other alkaloids from the aqueous extract, while leaving many of the other flavorful tobacco components present within the aqueous solvent. Preferred processes for denicotinizing aqueous tobacco extracts according to the present invention provide for the removal of greater than about 90 weight percent, preferably greater than about 95 weight percent of the nicotine present within the aqueous extract.

DETAILED DESCRIPTION OF THE PREFERRED EMBODIMENTS

Figure 1:
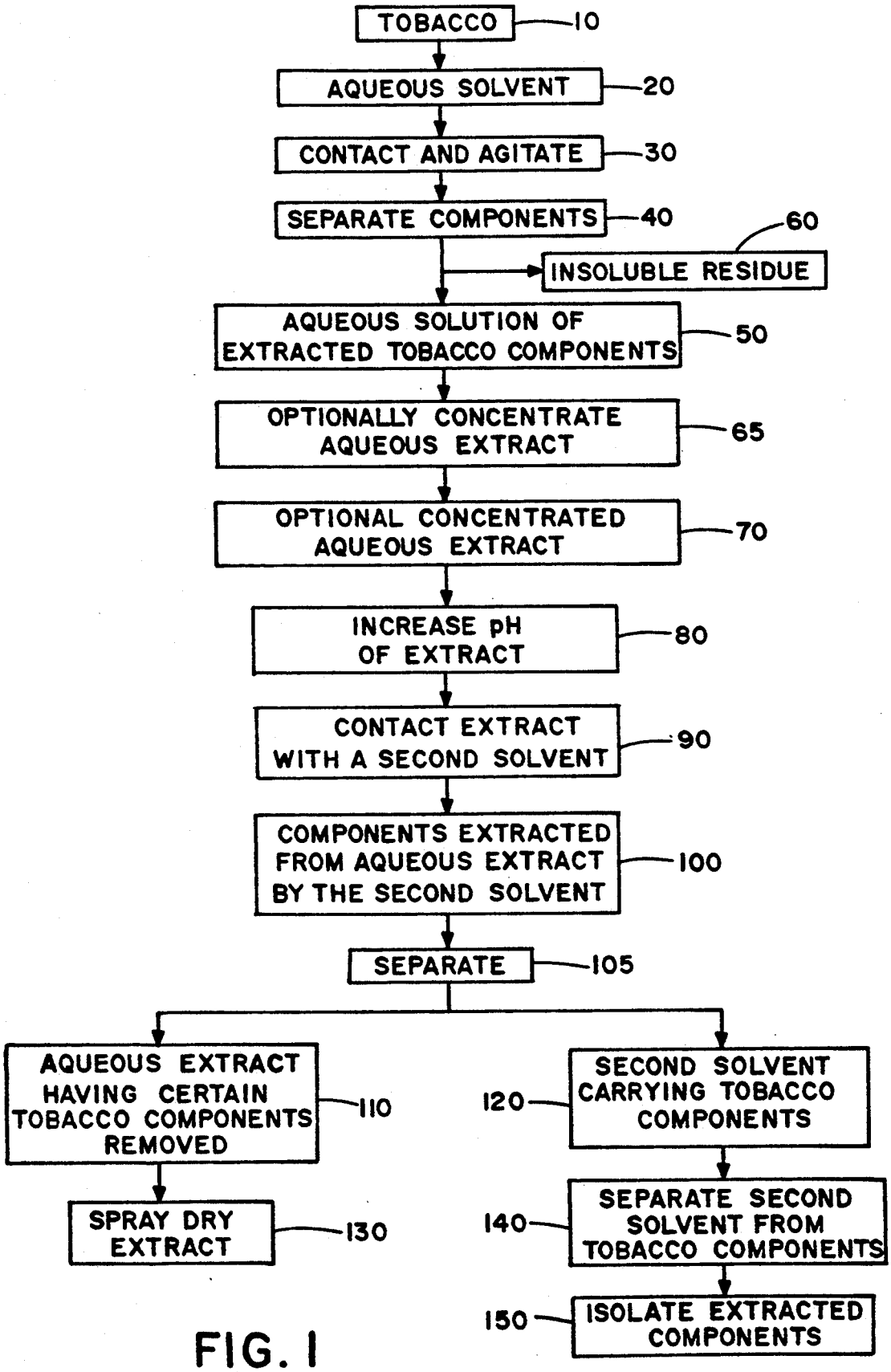
FIG. 1 is a schematic diagram of the process steps representative of one embodiment of this invention.

Referring to FIG. 1, tobacco material 10 is contacted with an aqueous solvent 20. The resulting mixture is stirred or otherwise agitated using a suitable agitation means 30. As a result, water soluble components are extracted from the tobacco by the solvent. The mixture is subjected to separation conditions 40 so as to provide a solution 50 of water soluble tobacco components (i.e., an aqueous tobacco extract) and a water insoluble residue 60. Optionally, the aqueous tobacco extract 50 then is concentrated 65 to an appropriate dissolved solids level using a thin film evaporator, or the like, such that a concentrated liquid tobacco extract 70 is obtained.

The liquid extract 70, which normally exhibits a pH below about 6, is contacted with a base 80 such as gaseous ammonia, an aqueous solution of ammonium hydroxide or solid potassium hydroxide to increase the pH of the extract to about 9 or above. The liquid extract having an increased pH is contacted with a second solvent 90, such as a long chain fatty alcohol. Tobacco components dissolved within the aqueous solvent are extracted 100 by the second solvent, which is in a liquid form. The two solvents then are separated 105 thereby yielding (i) an aqueous tobacco extract 110 having significant amounts of certain tobacco components (e.g., nicotine) removed therefrom, (ii) and a second solvent 120 carrying certain tobacco components (e.g., nicotine) soluble therein and which are extracted from the aqueous extract. The aqueous extract can be isolated, for example, by spray drying 130 the extract to yield a processed, tobacco extract powder. The second solvent can be separated 140 from the tobacco extract components therein to isolate the components 150 extracted thereby. The second solvent then can be reused for further liquid/liquid extraction processing steps.

Figure 2:
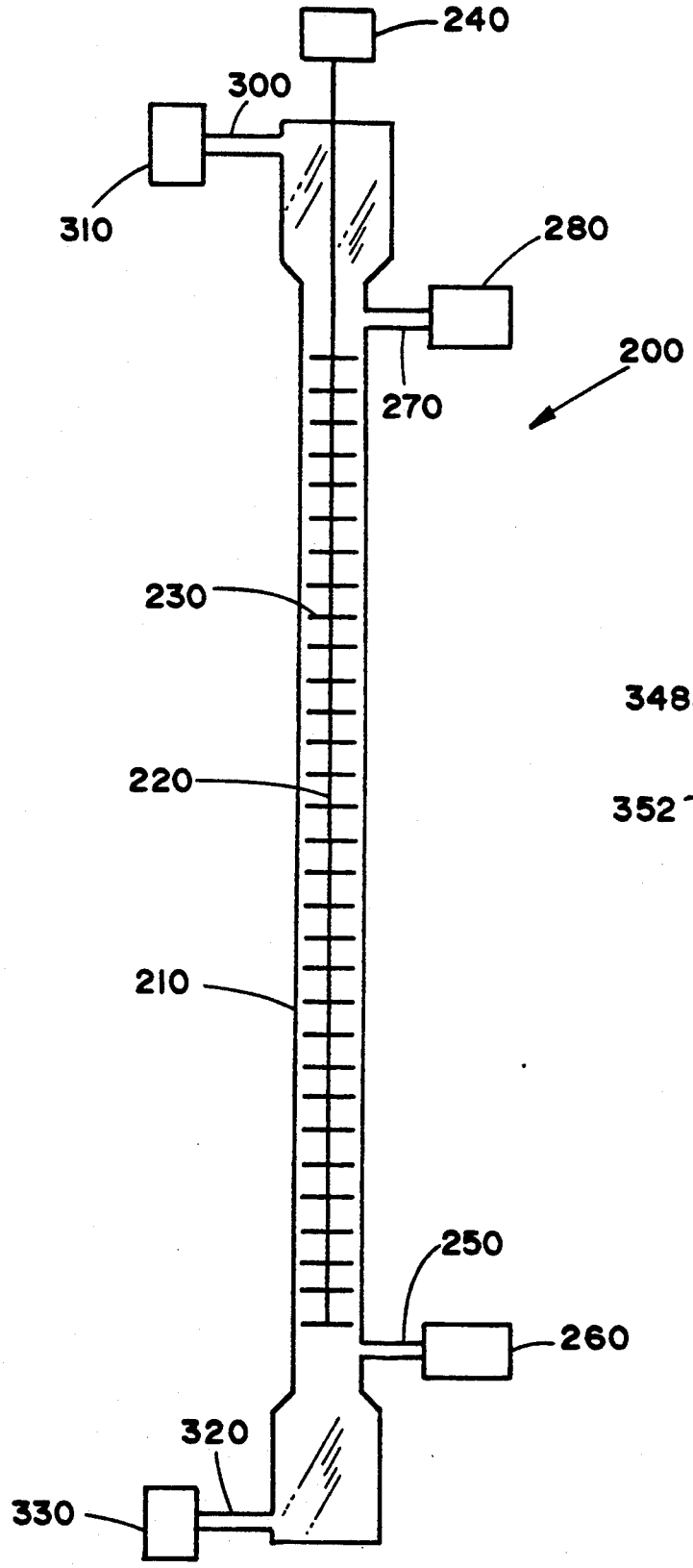
FIG. 2 is a schematic diagram of a representative apparatus for performing the process of this invention.

Referring to FIG. 2, an apparatus 200 for performing a liquid/liquid extraction process is shown. Such an apparatus is known to the skilled artisan as a Karr Reciprocating Plate Extraction Column. See, Karr, *A. I. Ch. E. Journ.*, Vol. 5, p. 446 (1959). The apparatus includes a long, slender tube or column 210 which is positioned such that the longitudinal axis thereof is in an essentially vertical plane. Essentially coaxially with the longitudinal axis of the column is inserted a shaft 220 which supports a plurality of extraction plates 230 spaced at intervals along the shaft. The plates 230 preferably are positioned perpendicularly to the shaft 220. The shaft is supported by a variable speed drive agitator 240 or other such means which moves the shaft (and hence the series of plates) periodically up and down. The column 210 includes a lower input region or nozzle 250 into which the second (e.g., light) solvent is fed continuously from source 260. The column also includes upper input region 270 or nozzle into which the first solvent containing extracted tobacco components are fed continuously from source 280.

The shaft 220 (and hence the plates 230) is reciprocated at a rate sufficient to provide adequate contact of the two solvents but at a sufficiently low rate so as to minimize or eliminate the formation of an undesirable emulsion of the first and second solvents. Conditions sufficient to prevent emulsion formation but ensure adequate contact of the two liquids will be apparent to the skilled artisan and can be determined by experimentation. The raffinate (i.e., the aqueous tobacco extract which has been contacted with the second solvent) exits the column 210 at output region 320 and is collected in reservoir 330. The second solvent and tobacco components carried thereby and which have been extracted from the first solvent exit the column at output region 300 and are collected in reservoir 310.

Figure 3:
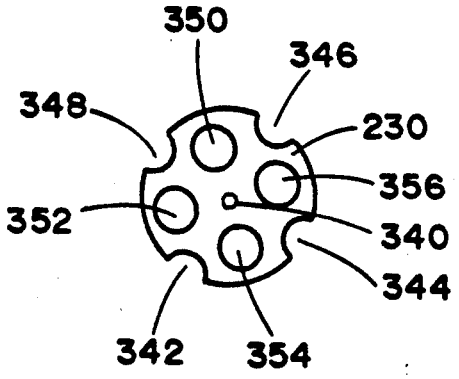
FIG. 3 is an enlarged view of a component of the apparatus shown in FIG. 2.

Referring to FIG. 3, there is shown an end view of a representative extraction plate 230 taken along the longitudinal axis of the column 210. The spacer 230 has a diameter which approximates the inner diameter of the column. The plate has an opening 340, through which the shaft extends. The plate also includes a series of peripheral openings 342, 344, 346 and 348 as well as inner openings 350, 352, 354 and 356, such that the liquid solvents can pass therethrough. Normally, the plate is manufactured from a metal such as stainless steel, a polymeric material such as Teflon, or the like.

The tobacco material can vary. Examples of suitable tobaccos include flue-cured, Burley, Md., and Oriental tobaccos, as well as the rare or specialty tobaccos. The tobacco material can be in the form of laminae and/or stem, or can be in a processed form. Tobacco waste materials and processing by-products such as fines, dust, scrap, stems and stalks can be employed. The aforementioned materials can be processed separately, or as blends thereof.

The tobacco material can have a variety of sizes for the first extraction. For example, the tobacco can be in strip form or cut filler form. Tobacco materials in strip or cut filler form are desirable in that the spent materials which remain after the extraction step can be dried or used as pulp, and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having an aqueous character. Such a solvent consists primarily of water, and can be essentially pure water in certain circumstances. However, the first solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the first solvent can vary. Typically, the weight of first solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 60° C., with about 15° C. to about 30° C. being preferred, and ambient temperature being particularly preferred. The solvent/tobacco material mixture can be agitated (e.g., stirred, shaken or otherwise mixed) in order to increase the rate at which extraction occurs. Typically, adequate extraction of components occurs in less than about 60 minutes, oftentimes less than about 30 minutes.

A wide variety of materials or components can be extracted from the tobacco materials. The particular materials and the amounts of the particular materials which are extracted often depend upon the type of tobacco which is processed, and properties of the particular solvent, and the extraction conditions (e.g., which include the temperature at which the extraction occurs as well as the time period over which an extraction is carried out). For example, a first solvent consisting essentially of pure water will most often extract primarily the water soluble components of the tobacco material, while a co-solvent mixture of water and a minor amount of an alcohol can extract the water soluble components of the tobacco material as well as certain amounts of components having other solubility characteristics.

The first extraction can be carried out in a batch-wise or continuous manner. Representative methods and conditions for extracting tobacco materials are set forth in U.S. patent application Ser. Nos. 484,587, filed Feb.

23, 1990; Ser. No. 505,339, filed Apr. 5, 1990 now U.S. Pat. No. 5,095,922; Ser. No. 720,308, filed Jun. 25, 1991; and Ser. No. 733,477, filed Jul. 22, 1991; and U.S. Pat. No. 5,025,812 to Fagg, et al.; which are incorporated herein by reference.

The first solvent and extracted components are separated from the insoluble residue. The manner of separation can vary; however, it is convenient to employ conventional separation means such as filtration, centrifugation, or the like. It is desirable to provide a solution of solvent and extracted components having a very low level of suspended solids.

The first solvent and components extracted thereby (e.g., the aqueous tobacco extract) can be concentrated, spray dried, freeze dried, or otherwise processed for storage or handling reasons. Dried materials such as spray dried materials later can be redissolved in the first solvent for later liquid/liquid extraction steps. If desired, the liquid tobacco extract can be subjected to processing conditions so as to denitrate or deproteinate the liquid extract or otherwise chemically or physically alter that extract.

The pH of the first solvent and extracted components can be altered, and typically the pH thereof is altered prior to the time that contact thereof with the second solvent is effected. The pH of the aqueous tobacco extract can be raised to promote removal of acidic compounds therefrom, or made neutral of promote removal of neutral compounds therefrom. For example, the pH of the aqueous tobacco extract can be raised so as to enhance the removal of alkaloids such as nicotine therefrom upon contact with the second solvent. Typically, for certain processes, the pH of the first solvent and extracted components is altered so as to be about 7 or more, frequently about 8 or more, and occasionally about 9 or more. It may be desirable to alter the pH of an aqueous tobacco extract, perform a liquid/liquid extraction step, collect the resulting aqueous phase, alter the pH of that aqueous phase, and perform a second liquid/liquid extraction step. Agents for altering the pH of the first solvent and extracted components will be apparent to the skilled artisan.

The amount of extracted tobacco components relative to the amount of first solvent during the liquid/liquid extraction step with the second solvent can vary. Although highly concentrated extracts can be employed, typically, the dissolved tobacco components present within the first solvent are less than about 25 weight percent, normally less than about 10 weight percent, and frequently about 5 weight percent or less.

The second solvent is an alcohol. The alcohol can be long chain or branched in structure, have a saturated or unsaturated long chain structure, or be an alcohol derivative. Fatty alcohols are particularly desirable. The alcohols useful herein usually contain at least about 8 carbon atoms, but normally contain less than about 20 carbon atoms. Such alcohols normally have a liquid form at near ambient conditions, or when heated slightly. Preferred alcohols have a liquid form at temperatures below about 80° C., and more preferably below about 60° C. Examples of suitable alcohols include stearyl alcohol, tallow alcohol, cetyl alcohol, oleyl alcohol, propoxylated fatty alcohols (e.g., polyoxypropylene (10) cetyl ether), myristyl alcohol, n-decyl alcohol, 1-hexadecanol, 1-octadecanol, n-octyl alcohol, tallow fatty alcohols, and the like. Preferred solvents have densities which are substantially different from that of the first solvent. For example, it is desirable for the density of the second solvent to differ from the first solvent by more than about 10 percent, often more than 15 percent.

The first and second solvents are immiscible with one another. By this is meant that the two solvents do not have a propensity to mix with one another, are essentially insoluble in one another and remain in distinct phases upon contact. Preferably, when the first and second solvents are contacted with one another under conditions at which the liquid/liquid extraction steps are performed, the two solvents do not emulsify to any significant degree. For many immiscible solvents useful according to this invention, the solubility of the second solvent in the first solvent normally is less than about 1 weight percent, and more preferably less than about 0.5 weight percent, at a temperature at which both solvents are in liquid form (e.g., 25° C.), although immiscible solvents having higher solubilities in one another can be employed. However, it is most desirable that the two solvents be very immiscible with one another.

The first solvent and components therewithin are contacted with the second solvent. Normally, the temperature of the column is controlled so that both of the first and second solvents remain in liquid form during the period of contact with one another. For example, it is desirable to maintain the first and second solvents at a temperature above about 40° C. at atmospheric pressure during the time that the first and second solvents are in contact, when the second solvent is an alcohol such as cetyl alcohol. Typically, the temperature at which the liquid/liquid extraction is performed is high enough to minimize or eliminate the formation of an emulsion but low enough to minimize or eliminate the vaporization of either or both of the solvents. As the first solvent is a liquid having an aqueous character, it is desirable to perform the extraction at a temperature of less than about 100° C., preferably less than 90° C. at atmospheric pressure.

The first and second solvents are subjected to conditions sufficient to transfer some tobacco extract components from within the first solvent to within the second solvent. For example, certain tobacco extract components which are carried by the first solvent may have a preferential solubility in the second solvent. In particular, when the first solvent is water and the aqueous tobacco extract has a pH of about 9 or more, a large portion of the nicotine and other alkaloids present within the aqueous extract are preferentially soluble in the second solvent (e.g., cetyl alcohol, oleyl alcohol or n-decyl alcohol).

After contact of the first and second solvents is effected, the respective solvents are separated from one another. Preferably, the contact of the solvents occurs for a period of time sufficient to provide transfer of a significant amount of the desired tobacco components from the first solvent to the second solvent. Additionally, it is preferable that agitation of the solvents during contact thereof be such that emulsification be minimized or eliminated. Determination of suitable conditions will be apparent to the skilled artisan. Typically, when a Karr Reciprocating Plate Extraction Column is employed to perform the liquid/liquid extraction process, the first solvent (e.g., the solvent carrying extracted tobacco components which remain after contact with the second solvent) exits the lower output region of the column and is collected; and the second solvent (e.g., the lighter solvent carrying certain extracted tobacco components removed from the first solvent) exits the upper output region of the column and is collected. Other apparatus for contacting and separating the two solvents and tobacco components extracted thereby (e.g., separation funnels, centrifugal extractors and rotating disc columns) will be apparent to the skilled artisan.

The tobacco components which are carried by the second solvent after the liquid/liquid extraction process normally are separated from the second solvent (i.e., isolated). Typically, the second solvent is distilled and the tobacco components contained therein are collected; or the tobacco components and the second solvent are co-distilled. Alternatively, when the second solvent has been used to extract basic components from the tobacco extract within the first solvent, the second solvent can be subjected to a liquid/liquid extraction process with an acidified aqueous solution to remove the basic components from the second solvent. Alternatively, substrates (e.g., membranes, porous beads or exchange resins) can be used to separate tobacco components from the second solvent. The second solvent, essentially absent of any tobacco components, then can be re-employed as a solvent for further liquid/liquid extraction processing steps. The resulting isolated tobacco components also can be collected and employed as tobacco extracts in smoking article manufacture.

The tobacco components which remain within the first solvent after the liquid/liquid extraction process can be employed as is, concentrated and employed, or separated from the first solvent (i.e., isolated). For example, the liquid which is collected after the liquid/liquid extraction process can be freeze dried, spray dried, or the like, so that at least a portion or a great majority of the first solvent is removed therefrom. See, for example, U.S. Pat. No. 5,012,812 to Fagg, et al., and U.S. patent application Ser. No. 484,587, filed Feb. 23, 1990, now U.S. Pat. No. 5,065,775. As such concentrated tobacco extracts in stabilized be provided.

The processed extracts within each of the first and second solvents and the concentrated extracts often are useful as flavorful forms of tobacco for cigarettes and other smoking articles. For example, the concentrated extracts can be employed as casing or top dressing components during the preparation of smokable cut filler for the manufacture of cigarettes. As another example, the processed tobacco extracts can be applied to the spent materials from the first stage extraction, particularly after the spent materials have been formed into a sheet-like mat using papermaking techniques. See, for example, those techniques described in U.S. Pat. No. 4,987,906 to Young, et al. The processed tobacco extracts can be employed in those processes set forth in U.S. Pat. No. 5,025,812 to Fagg, et al., and U.S. patent application Ser. No. 484,587, filed Feb. 23, 1990, now U.S. Pat. No. 5,065,777; 720,308, filed Jun. 25, 1991 and Ser. No. 733,477, filed Jul. 22, 1991. The resulting smokable materials can be used in cigarette manufacture.

Alternatively, the processed extracts and concentrated extracts can be employed as forms of tobacco in those smoking articles described in U.S. Pat. No. 4,708,151 to Shelar; U.S. Pat. No. 4,714,082 to Banerjee et al; U.S. Pat. No. 4,756,318 to Clearman et al.; U.S. Pat. No. 4,793,365 to Sensabaugh, Jr., et al.; U.S. Pat. No. 4,991,596 to Lawrence, et al., and U.S. Pat. No. 5,027,837 to Clearman, et al.

The following examples are provided in order to further illustrate various embodiments of the invention but should not be construed as limiting the scope thereof. Unless otherwise noted, all parts and percentages are by weight.

EXAMPLE 1

An aged blend of 49.25 parts flue-cured, 28.5 parts Burley and 22.25 parts Oriental tobaccos in cut filler form and having a nicotine content of about 2.5 percent is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation conditions are such that water is evaporated from the extract while loss of volatiles is minimized. The concentrated aqueous extract then is spray dried by continuously pumping the aqueous solution to an Anhydro size No. 1 spray dryer. The dried powder is collected at the outlet of the dryer. The inlet temperature of the spray dryer is about 215° C., and the outlet temperature is about 82° C.

The spray dried material is a brown, powdery material and has a moisture content of about 5 percent, and a nicotine content of about 5 percent.

The spray dried extract is contacted with water at ambient temperature in the amount of 10 parts extract to 90 parts water to yield a dark brown liquid. A solution of water soluble tobacco extract in water is provided, and exhibits a pH of about 5. To the solution is added a sufficient amount of a solution of ammonium hydroxide in water to provide a starting aqueous tobacco extract exhibiting a pH of about 10. The solution exhibits a nicotine content of about 0.46 percent.

Into a 250 ml separation funnel is charged about 50 ml of the aqueous tobacco extract, and about 100 ml of cetyl alcohol available as Product CO-1695F Cetyl Alcohol from The Proctor & Gamble Distributing Co. which has been heated to about 50° C. The funnel is shaken gently about 25 times over a 2 minute period while the outside walls of the funnel are heated to maintain the alcohol at about 50° C. The shaken mixture is allowed to set at 50° C., and allowed to separate as two layers. After about 2 minutes, the bottom layer is removed from the funnel and collected, while warm.

The collected aqueous liquid (i.e., bottom layer) is dark brown in color, and the alcohol layer is light yellow in color and is clear. About 97 percent of the nicotine present in the starting aqueous extract is removed therefrom. The collected aqueous liquid is subjected to two more extraction treatments using cetyl alcohol. The collected aqueous liquid from each further extraction exhibits a nicotine removal of about 99 percent and over 99 percent, respectively, as compared to the starting aqueous extract.

EXAMPLE 2

A spray dried tobacco extract is provided as described in Example 1. A starting aqueous tobacco extract exhibiting a pH of about 10 is provided from the spray dried extract, as described in Example 1.

Into a 250 ml separation funnel is charged about 50 ml of the aqueous tobacco extract, and about 100 ml of oleyl alcohol available as Novol from Croda, Inc. Each of the liquids are at ambient temperature. The funnel is shaken gently about 25 times over a 2 minute period. The shaken mixture is allowed to set at ambient temperature for about 5 minutes. The bottom layer then is removed from the funnel and collected.

The collected aqueous liquid is dark brown in color, and the alcohol layer is light yellow in color and is clear. About 70 percent of the nicotine present in the nicotine present in the starting aqueous extract is removed therefrom. The collected aqueous liquid is subjected to two more extraction treatments using oleyl alcohol. The collected aqueous liquid from each further extraction exhibits a nicotine removal of about 96 percent and about 98 percent, respectively, as compared to the starting aqueous extract.

EXAMPLE 3

A spray dried tobacco extract is provided as described in Example 1. A starting aqueous tobacco extract having about 15 parts extract and about 85 parts water, and exhibiting a pH of about 10 is provided from the spray dried extract, essentially as described in Example 1.

Into a 50 ml separation funnel is charged about 20 ml of the aqueous tobacco extract, and about 20 ml of n-decyl alcohol available from Fischer. Each of the liquids are at ambient temperature. The funnel is shaken gently about 25 times over a 2 minute period. The shaken mixture is allowed to set at ambient temperature for about 2 minutes. The bottom layer then is removed from the funnel and collected.

The collected aqueous liquid is dark brown in color, and the alcohol layer is light yellow in color and is clear. About 52 percent of the nicotine present in the nicotine present in the starting aqueous extract is removed therefrom. The collected aqueous liquid is subjected to two more extraction treatments using n-decyl alcohol. The collected aqueous liquid from each further extraction exhibits a nicotine removal of about 96 percent and about 98 percent, respectively, as compared to the starting aqueous extract.

What is claimed is:

1. A process for providing a tobacco extract, the process comprising the steps of:

(i) extracting components from tobacco material with a first solvent having an aqueous character, (ii) providing a liquid extract of tobacco within the first solvent, (iii) contacting the first solvent and tobacco extract therewithin with a second liquid solvent which is immiscible with the first solvent and is an alcohol, (iv) subjecting contacted first and second solvents to conditions sufficient to transfer some tobacco extract components from within the first solvent to within the second solvent, and (v) separating the first and second solvents from one another.

2. The process of claim 1 whereby the first solvent is water.

3. The process of claim 1 whereby the second solvent includes cetyl alcohol.

4. The process of claim 1 whereby the first solvent is a co-solvent mixture.

5. The process of claim 1, 2, or 3 whereby the density of the second solvent differs from the first solvent by more than 10 percent.

6. The process of claim 1, 2 or 3 whereby the first and second solvents are subjected to conditions sufficient to transfer tobacco components from within the first solvent to within the second solvent at a temperature less than about 80° C. at atmospheric pressure.

7. The process of claim 1, 2 or 3 whereby the solubility of the second solvent within the first solvent at 25° C. is less than 1 weight percent.

8. The process of claim 1, 2 or 3 whereby the liquid extract of tobacco within the first solvent is provided so as to have a pH of about 7 or more prior to the time that contact thereof with the second liquid solvent is effected.

9. The process of claim 1, 2 or 3 whereby the liquid extract of tobacco within the first solvent is provided so as to have a pH of about 8 or more prior to the time that contact thereof with the second liquid solvent is effected.

10. The process of claim 1, 2 or 3 whereby the liquid extract of tobacco within the first solvent is provided so as to have a pH of about 9 or more prior to the time that contact thereof with the second liquid solvent is effected.

11. The process of claim 1 whereby the tobacco components within the first first solvent are separated from at least a portion of the solvent after step (v).

12. The process of claim 1 whereby the second solvent includes n-decyl alcohol.

13. The process of claim 1 whereby the second solvent is an alcohol which contains at least about 8 carbon atoms and less than about 20 carbon atoms.

14. The process of claim 13 whereby the solubility of the second solvent within the first solvent at 25° C. is less than 1 weight percent.

15. The process of claim 13 or 14 whereby the liquid extract of tobacco within the first solvent is provided so as to have a pH of about 7 or more prior to the time that contact thereof with the second liquid solvent is effected.

16. The process of claim 13 or 14 whereby the first and second solvents are subjected to conditions sufficient to transfer tobacco components from within the first solvent to within the second solvent at a temperature less than about 80° C. at atmospheric pressure.

17. The process of claim 1 or 13 whereby the first and second solvents are maintained at a temperature above about 40° C. while those solvents are in contact with one another.

18. The process of claim 1 whereby the second solvent includes oleyl alcohol.

19. The process of claim 1 or 2 whereby the second solvent includes a fatty alcohol.

* * * * *